US007625180B1

(12) United States Patent
Liang

(10) Patent No.: US 7,625,180 B1
(45) Date of Patent: Dec. 1, 2009

(54) TURBINE BLADE WITH NEAR-WALL MULTI-METERING AND DIFFUSION COOLING CIRCUIT

(75) Inventor: George Liang, Palm City, FL (US)

(73) Assignee: Florida Turbine Technologies, Inc., Jupiter, FL (US)

( * ) Notice: Subject to any disclaimer, the term of this patent is extended or adjusted under 35 U.S.C. 154(b) by 562 days.

(21) Appl. No.: 11/600,447

(22) Filed: Nov. 16, 2006

(51) Int. Cl.
*F01D 5/18* (2006.01)

(52) U.S. Cl. ..... 416/97 R; 29/889.2

(58) Field of Classification Search ..... 416/97 R, 416/96 R, 96 A; 415/115; 29/889.2
See application file for complete search history.

(56) References Cited

U.S. PATENT DOCUMENTS 4,183,716 A * 1/1980 Takahara et al. ..... 416/96 A
5,100,293 A * 3/1992 Anzai et al. ..... 416/96 A
5,419,039 A * 5/1995 Auxier et al. ..... 29/889.721
5,484,258 A * 1/1996 Isburgh et al. ..... 415/115
5,626,462 A 5/1997 Jackson et al.
5,640,767 A 6/1997 Jackson et al.
5,660,524 A 8/1997 Lee et al.
5,688,104 A * 11/1997 Beabout ..... 415/115
5,720,431 A 2/1998 Sellers et al.
5,820,337 A 10/1998 Jackson et al.
6,168,871 B1 1/2001 Ritter et al.
6,533,547 B2 * 3/2003 Anding et al. ..... 416/97 R
6,582,194 B1 6/2003 Birkner et al.
6,602,053 B2 8/2003 Subramanian et al.
6,709,230 B2 3/2004 Morrison et al.
6,769,866 B1 * 8/2004 Kannefass et al. ..... 415/115

* cited by examiner

*Primary Examiner*—Ninh H Nguyen
(74) *Attorney, Agent, or Firm*—John Ryznic

(57) ABSTRACT

A turbine airfoil with a near wall cooling design that reduces the airfoil main body metal temperature and reduces the cooling flow requirement for increased turbine efficiency. The airfoil includes a main body portion with internal cooling air supply cavities separated by one or more ribs, and a plurality of impingement cells formed on the outer surface on the pressure side and suction side of the airfoil main body. The impingement cells with film cooling holes are formed by placing a filler material within the cells and partially formed film cooling holes extending from the side wall of the cell. A thin outer airfoil wall is formed over the main body with the filler material filled cells. The filler material is leached out from the airfoil, leaving the impingement cells with the film cooling hole extending out from the side and covered by the thin outer airfoil wall. The airfoil is thus formed with a thin outer wall and the film cooling holes are formed within the outer wall without machining. The film cooling holes can be formed as straight holes, diffusion holes, or metering and diffusions holes. Also, the metering and diffusion hole connecting the cooling supply cavity to the impingement cell can be varied throughout the airfoil to regulate the pressure and cooling flow over the airfoil to control the metal temperature thereof.

23 Claims, 2 Drawing Sheets

TURBINE BLADE WITH NEAR-WALL MULTI-METERING AND DIFFUSION COOLING CIRCUIT

BACKGROUND OF THE INVENTION

1. Field of the Invention

The present invention relates generally to fluid reaction surfaces, and more specifically to turbine airfoils with cooling circuits.

2. Description of the Related Art Including Information Disclosed Under 37 CFR 1.97 and 1.98

A gas turbine engine produces mechanical power from burning a fuel. A compressor supplies compressed air to a combustor in which a fuel is burned to produce an extremely hot gas flow. The hot gas flow is passed through a turbine to convert the hot gas flow into mechanical energy by driving the turbine. In a typical industrial gas turbine, the turbine shaft drives the compressor and an electric generator to produce electrical power.

The engine efficiency can be increased by providing for a higher temperature in the hot gas flow entering the turbine. An industrial gas turbine typically has four stages with stator vanes located upstream of the rotor blades. The first stage stator vanes and rotor blades are exposed to the highest flow temperature. Therefore, the materials used in this turbine parts limit how high the temperature can be.

Once the materials used for the first stage vanes and blades are maximized with respect to the highest temperature allowed, the airfoils in question can include cooling air to allow for a further increase in the operating temperature. Complex cooling air circuitry has been proposed in the prior art to not only maximize the cooling ability of the airfoils but to also minimize the amount of cooling air sued. Since the pressurized cooling air used in these airfoils typical comes from bleed off air from the compressor, minimizing the amount of cooling air used will also increase the efficiency of the engine.

Turbine airfoils generally include hot spots on the airfoil surface where higher temperatures are found. Therefore, some parts of the airfoil require more cooling than other parts. Hot spots can reduce the life of a turbine airfoil due to lack of adequate cooling in the certain spots. Turbine airfoils can be cooled by a combination of convection cooling, impingement cooling, and film cooling. One or more for these cooling methods can be used in selective locations around the airfoil.

Another way in which the increased use of cooling air can be avoided, or cooling air requirements can be reduced, is by providing metal parts that are capable of operating above the maximum use temperature of 1,150.degree. C. The provision of metal parts capable of operating at temperatures beyond 1,150.degree. C. would allow either relaxation of cooling requirement or the reduction or elimination of the dependence on the thermal barrier coatings, or both.

It is also well known that the operating efficiency of gas turbine engines may be improved by reducing the total weight of the metal parts utilized. Currently, because of the required intricate internal cooling passages within metal parts such as blades and vanes, particularly near their outer surfaces, and the fragile nature of the ceramic cores used to define these passages during formation, it is necessary to utilize large tolerances that allow for the possibility of core shifting. The use of materials and processes that would simplify the design requirements for these internal passages would permit the amount of material used in each metal part to be reduced. Also, the use of materials that are less dense would achieve weight reductions for each metal part. Small savings can be significant because of the large number of these metal parts that are utilized in a typical engine.

Prior art near wall cooling arrangements utilized in an airfoil main body is constructed with radial flow channel plus re-supply holes in conjunction with film discharge cooling holes. As a result of this cooling construction approach, span-wise and chord-wise cooling flow control due to airfoil external hot gas temperature and pressure variation is difficult to achieve. In addition, a single radial channel flow is not the best method of utilizing cooling air. This results in a low convective cooling effectiveness.

U.S. Pat. No. 5,640,767 issued to Jackson et al on Jun. 24, 1997 and entitled METHOD FOR MAKING A DOUBLE-WALL AIRFOIL discloses a turbine airfoil with an airfoil skin formed over a partially hollow airfoil support wall with a plurality of longitudinally extending internal channels formed between the skin and the wall. Film cooling holes are formed in the skin after the skin has been secured to the airfoil wall. Because the internal channels that supply cooling air extend along the span-wise length of the airfoil, the cooling requirements cannot be adjusted for along the span-wise direction of the airfoil.

U.S. Pat. No. 6,582,194 B1 issued to Birkner et al on Jun. 24, 2003 and entitled GAS-TURBINE BLADE AND METHOD OF MANUFACTURING A GAS-TURBINE BLADE discloses a turbine blade with a metal blade body having peg-like elevations extending outward and forming spaces between adjacent pegs. A coating of ceramic material is applied within the spaces and flush with a top of the pegs, and a covering coat applied over to form an outer wall of the blade. The ceramic material is leached away to leave impingement spaces. Oblique film cooling holes are then formed in the outer wall. The impingement channels in the Birkner patent also extends along the span-wise length of the blade, and therefore the amount of cooling air cannot be adjusted to vary the cooling amount along the span-wise direction of the blade. In the above cited prior art references, the film cooling holes are formed in the outer wall of the airfoil in a separate process, usually by laser drilling the holes. Drilling the film cooling holes after the outer wall and the impingement cell or cavity has been formed requires an extra manufacturing process that increases the cost of making the airfoil.

Thin walled airfoils are desirable because the thin walls can be cooled by impingement air and film cooling air. However, thin walls are difficult if not impossible to cast into an airfoil. An improvement for the airfoil main body near-wall cooling can be achieved by incorporation of the present invention into the airfoil main body cooling design of the cited prior art references.

It is an object of the present invention to provide for a turbine airfoil with a thin outer wall having near wall cooling.

It is another object of the present invention to provide for a turbine airfoil with cast in place film cooling holes in order to reduce the manufacture steps to make the airfoil.

It is another object of the present invention to provide for a turbine airfoil that includes a plurality of modules to provide cooling to the airfoil at pre-specified amounts in order to increase the life of the airfoil.

BRIEF SUMMARY OF THE INVENTION

The present invention is a turbine airfoil with a thin outer wall formed over an inner airfoil structure. The inner airfoil structure has a general airfoil shape and an inner portion with cooling air supply channels, a plurality of individual impingement cells facing outward from the airfoil inner portion and metering/impingement holes in the inner airfoil structure connecting the internal cooling supply channels to the individual impingement cells. Each impingement cell includes a film cooling holes to provide film cooling to the outer airfoil wall surface. The impingement cells and film cooling holes are formed by filling the open cells in the inner airfoil structure with a ceramic material, forming the outer airfoil wall over the ceramic filled impingement cells, and then leaching away the ceramic material to leave the open impingement cells and the film cooling holes. The present invention provides for a unique near-wall cooling arrangement for a turbine airfoil main body region which will greatly reduce the airfoil main body temperature and therefore reduce the cooling flow requirement and improve the turbine efficiency.

The airfoil of the present invention provides for an improved near-wall cooling using multiple modules of diffusion cavities with multi-metering and impingement cooling for the airfoil main body. The multi-metering and impingement diffusion cavity cooling arrangement is constructed in small individual cavity formation. The individual cavity is designed based on the airfoil gas side pressure distribution in both chord-wise and span-wise directions. In addition, each individual cavity can be designed based on the airfoil local external heat load to achieve a desired local metal temperature. The individual small cavities are constructed in a staggered arrangement along the airfoil wall. Using the unique cooling arrangement of the present invention, a maximum usage of cooling air for a given airfoil inlet gas temperature and pressure profile is achieved. In addition, the multi-metering and diffusion cooling construction utilizes the multi-impingement cooling technique for the backside convective cooling as well as flow metering. The spent cooling air discharges onto the airfoil surface forming a multi-slot film cooling array for very high film coverage. The combination effects of multi-hole impingement cooling plus multi-slot film cooling yields a very high cooling effectiveness and uniform wall temperature for the airfoil main body wall.

DETAILED DESCRIPTION OF THE INVENTION

The present invention relates generally to a method of making a turbine airfoil and a turbine airfoil apparatus, such as a turbine blade or a turbine vane, for use at a high temperature. More particularly, this invention relates to a method of making an airfoil having a double wall construction with an integral cooling channel and a plurality of impingement cavities or cells connected to the channel. Most particularly, this invention relates to a method of making a double wall airfoil and a double wall airfoil apparatus having a thin layered outer wall with film cooling holes formed therein and a plurality of impingement cells or cavities connected to the film cooling holes.

Figure 1:
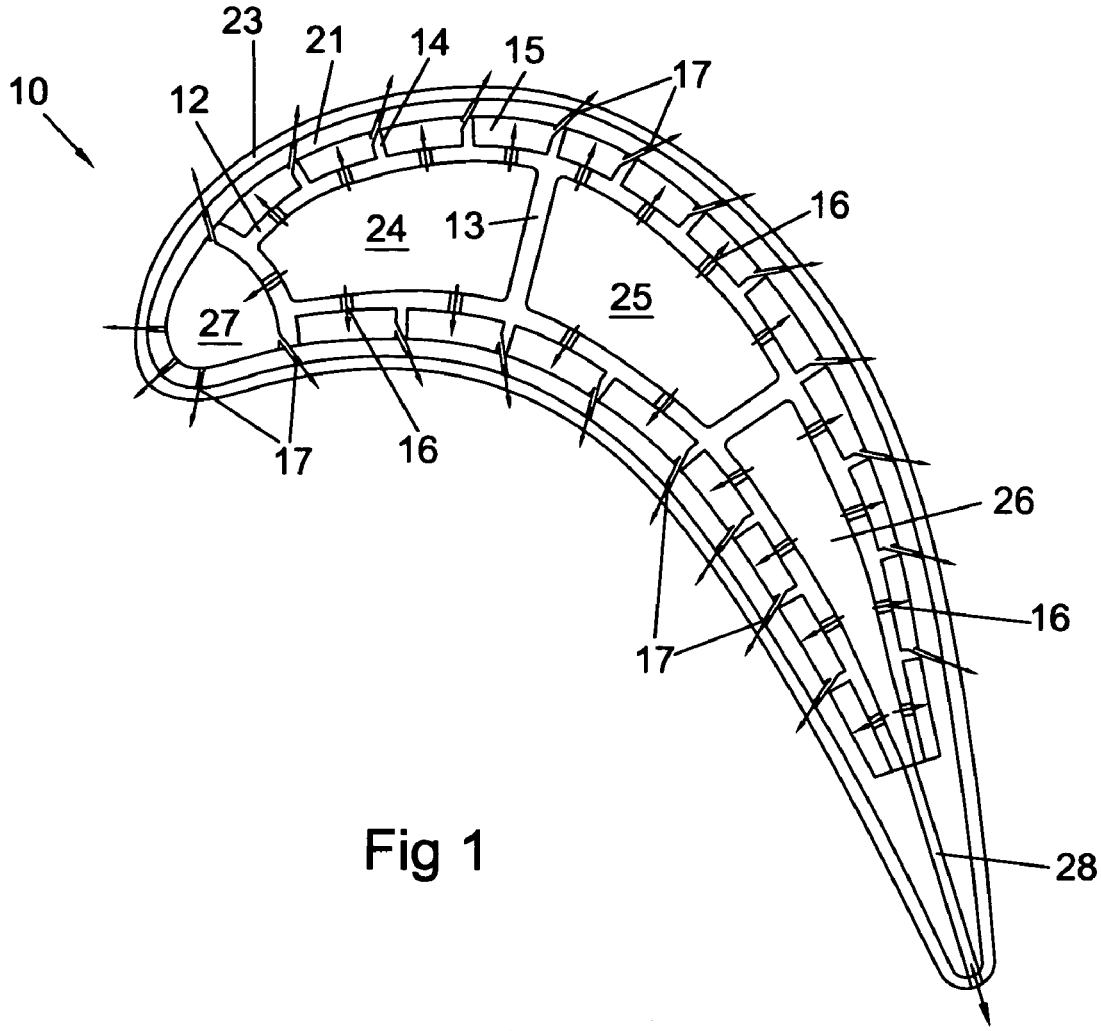
FIG. 1 shows a schematic cross section view of an airfoil of the present invention.

FIG. 1 shows a cross section view of the airfoil 10 of the present invention. The main airfoil structure or support is shown as 12 and has the general shape of the airfoil. In this particular invention, the airfoil can be either a rotor blade or a stator vane used in the turbine section which is exposed to extremely high gas temperature flow such that the airfoil requires internal and external cooling. The airfoil support 12 includes one or more ribs 13 extending from the pressure side to the suction side and separating the interior of the airfoil structure support into cooling supply channels. In the FIG. 1 embodiment, two ribs separate three cavities 24, 25, and 26. Formed on the outer surface of the airfoil support structure 12 is a plurality of cells or cavities 15 having a generally rectangular shape. The cells 15 can have different shapes depending upon the cooling requirements and the casting. The cells are cast into the airfoil support structure 12 in order to simplify the manufacture of the airfoil. For an industrial gas turbine engine airfoil such as a first stage blade, the cells are about one inch in length in the blade span-wise direction, about one half inch in length in the blade chord-wise length, and from about 0.05 inch to about 0.2 inch deep. Each cell 15 is connected to the supply channel 24 by a metering and impingement hole 16. The metering and impingement hole 16 can be cast into the airfoil structure 12 or formed after the casting by any well known drilling or hole forming technique. A leading edge cavity 27 is formed in the airfoil structure in the leading edge region of the airfoil.

Figure 2A:
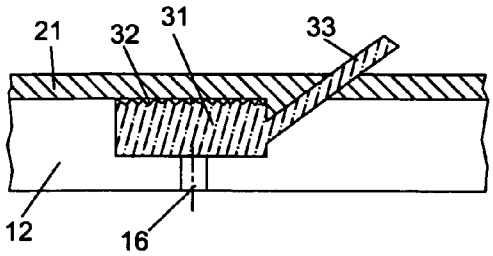
FIG. 2*a* shows a cross section of a side view of an impingement cavity and film cooling hole with the filler material in place.
Figure 2B:
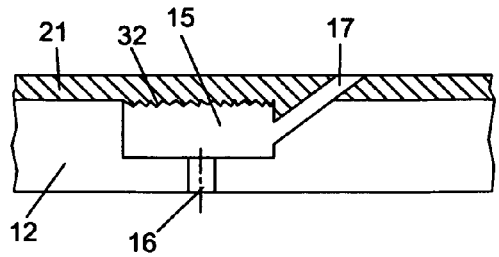
FIG. 2*b* shows a cross section view of the ceramic material leached out and leaving the impingement cavity and film cooling hole.

The cells 15 that form the impingement cavity in the airfoil are formed by placing a ceramic filler material 31 in the part of the airfoil structure 12 that forms the cell 15 and a filler material 33 extending from 31 that forms the bottom of the film cooling hole as seen in FIG. 2*a*. The filler material 31 and 33 is a single piece that is solid and is placed within the cell and cooling hole forming surface in the airfoil structure 12. The film cooling hole will extend from the side wall of the cell 15 and out to the airfoil outer surface at an angle. The cell 15 and film cooling hole in the airfoil support structure 12 can be formed during the casting or machined into the airfoil structure after casting. The ceramic filler material 31 with the film cooling hole formation 33 extending from the side of the cell 15 to the outer airfoil wall surface is placed in the open space and an outer wall 21 is formed over the ceramic filler material 31 and 33. Before the ceramic filler material 31 is placed in the cell 15, the metering and impingement hole 16 is formed in the airfoil support structure 12. The ceramic filler material 31 used to form the cell 15 includes a roughened surface on the top that will form the turbulators or trip strips along the inner surface of the outer wall 21. When the outer airfoil wall surface 21 is formed on the airfoil support structure 12, the ceramic filler material is leached out to leave the impingement cell 15 and the film cooling hole 17 in the airfoil 10 as seen in FIG. 2*b*. The airfoil outer wall 21 can be applied by an electron beam (EB process), physical vapor deposition (PVD) process, or sprayed on by the well known processes of forming thin layers. The resulting cells 15 form diffusion and impingement cavities within the airfoil. A TBC 23 can be applied over the outer airfoil wall 21 to enhance the heat resistance of the airfoil 10.

Figure 5:
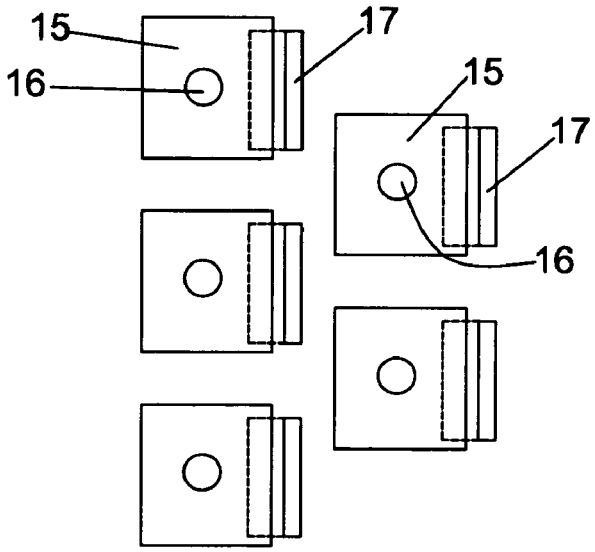
FIG. 5 shows a side view of a portion of the wall of an airfoil of the present invention with a plurality of staggered impingement cells.

The cells 15 are formed in the airfoil structure along a staggered arrangement as seen in FIG. 5. One row of cells 15 is spaced along the span-wise length of the airfoil, while an adjacent row of cells is spaced such that the cell is located about midway between cells in the adjacent row. The cells 15 can have a square shape as shown in FIG. 5, or the cells 15 can have a rectangular shape such that either the height or the width as seen in FIG. 5 can be larger than the other. The metering and impingement hole 16 is shown centered within the cell 15. However, the hole 16 can be located off-center if desired. Also, more than one hole 16 can be used for each individual cell 15.

Because of the individual cells 15 spaced along the airfoil wall, the metering and impingement holes 16 can be sized in order to regulate the pressure and cooling air flow into the cells and out through the film cooling holes 17 such that hot spots arranged around the airfoil 10 will have the proper amount of cooling air at the required pressure while other locations along the airfoil will not be over-cooled.

Another advantage of the present invention over the cited prior art references is that the outer airfoil wall surface 21 can be formed thin and will the film cooling holes formed within the outer surface 21. Thin outer walls are nearly impossible to cast into an airfoil. Therefore, the present invention provides for a method of forming a thin walled airfoil with diffusion and impingement cavities or cells formed below the surface, and with film cooling holes extending from the impingement cavity and opening onto the airfoil surface.

In operation, cooling air is supplied through the airfoil internal cavity (24, 25, or 26) and then metered through the impingement holes 16 into the multi-cavity module or cell 15. Cooling air is then diffused into the cooling cavity or cell 15 and then metered and diffused within the film cooling slot 17 prior to being discharged onto the airfoil surface through an array of multiple small slots 17. The exit diffusion film slot 17 can be in many shapes. For example, the exit film diffusion slot 17 can be a very narrow channel, a straight upstream wall with a curved downstream wall, or a double curved wall for both the upstream and downstream walls of the slot. In addition, the multi-cavity modulus can be inserted into the airfoil main ceramic core prior to the injection of inserting into the wax die for the injection of wax.

Figure 3A:
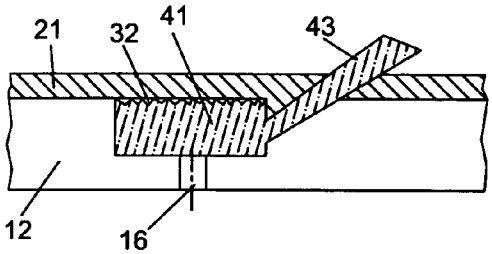
FIG. 3*a* shows a cross section of a side view of an impingement cavity and film cooling hole with the filler material in place in a second embodiment of the invention.
Figure 3B:
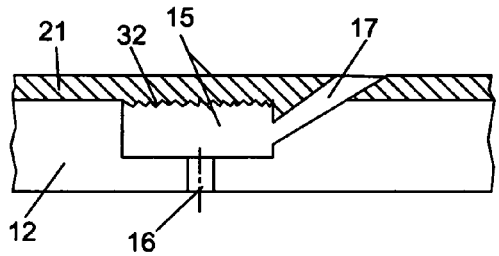
FIG. 3*b* shows a cross section view of the ceramic material leached out and leaving the impingement cavity and film cooling hole in a second embodiment of the invention.

FIG. 3*a* shows a second embodiment of the film cooling hole forming process of the present invention. Like the FIG. 2*a* embodiment, the cell 15 is formed by placing a ceramic filler material 41 within the space that forms the cell 15 and a filler material 43 extending from 41 that forms the film cooling hole 17. In the FIG. 3*a* embodiment, the film cooling hole is a diffusion hole because of the expanding cross sectional area of the film cooling hole in the downstream flow direction. FIG. 3*b* shows the airfoil with the impingement cell 15 and film cooling hole 17 after the ceramic filler 41 is leached out.

Figure 4A:
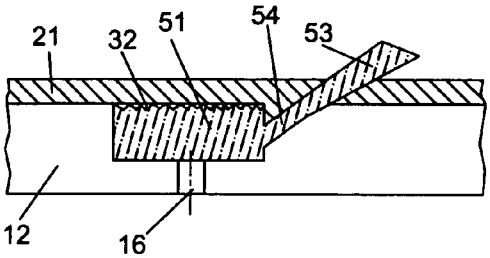
FIG. 4*a* shows a cross section of a side view of an impingement cavity and film cooling hole with the filler material in place in a third embodiment of the invention.
Figure 4B:
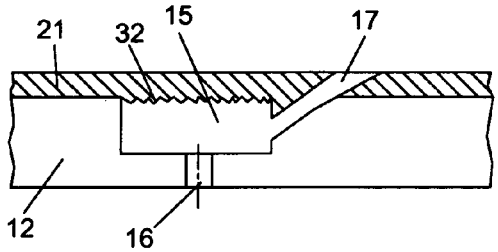
FIG. 4*b* shows a cross section view of the ceramic material leached out and leaving the impingement cavity and film cooling hole in a third embodiment of the invention.

FIG. 4*a* shows a third embodiment of the film cooling hole forming process of the present invention. In the FIG. 4*a* embodiment, the film cooling hole 17 is formed by a filler material that includes a metering portion 54 and a diffusion portion 53 located in the downstream flow direction. A filler material 51 that forms the cell 15 is the same in the previous two embodiments, and the filler materials 54 and 53 extend there from to form a single piece to form both the cell 15 and the film cooling hole 17. The airfoil with the film cooling holes 17 of the second and third embodiments of FIGS. 3*a* and 4*a* are formed the same way as described in the first embodiment of FIG. 2. The ceramic filler materials used to form the cell 15 or cavity and the film cooling hole 17 is leached out after the outer airfoil surface 21 is formed over the airfoil support structure 12 as seen in FIG. 4*b*. The film cooling hole thus includes a metering portion and a diffusion portion located downstream in the flow direction from the metering portion.

The turbine airfoil 10 of the present invention includes a plurality of staggered diffusion and impingement cells 15 arranged along the airfoil support structure 12, with each cell 15 including one or more film cooling holes 17 having the shape of one of the embodiments in FIGS. 2 through 4. In a single airfoil 10, some of the cells 15 can have film cooling holes 17 with the shape of that shown in FIG. 2, some can have holes with the shape as that shown in FIG. 3 and some can have the shape of that shown in FIG. 4. Or, the airfoil 10 can have all of the film cooling holes with the shape of only one of the embodiments of FIGS. 2 through 4.

I claim the following:

1. A turbine airfoil comprising:

an airfoil main structure having the general shape of the airfoil and forming a leading edge and a trailing edge, and a pressure side and a suction side of the airfoil structure, the airfoil main structure forming a cooling air supply cavity;

a plurality of impingement cells formed on the airfoil main structure on the pressure side and the suction side;

an impingement hole connecting the cooling air supply cavity to the impingement cell;

a film cooling hole connecting the impingement cell to an outer surface of the airfoil;

a thin outer wall secured over the airfoil main structure, the thin outer wall enclosing the impingement cell and forming part of the film cooling hole; and, the rows of impingement cells are staggered in which an impingement cell in a first row is positioned between adjacent impingement cells in an adjacent second row.

2. The turbine airfoil of claim 1, and further comprising:

a rib extending from the pressure side to the suction side of the airfoil main structure, the rib separating a first cooling air supply cavity from a second cooling air supply cavity.

3. The turbine airfoil of claim 2, and further comprising:

a plurality of the impingement cells formed along the pressure side and the suction side of the airfoil main structure, each impingement cell being connected to one of the two cooling air supply cavities through an impingement hole.

4. The turbine airfoil of claim 3, and further comprising:

the plurality of impingement cells are substantially rectangular in shape and arranged along rows in the airfoil span-wise direction.

5. The turbine airfoil of claim 2, and further comprising:

A second rib separating the second cooling air supply cavity from a third cooling supply cavity;

A plurality of impingement cells formed on the airfoil main structure on the pressure side and the suction side and connected to the third cooling air supply cavity through impingement holes; and, A plurality of cooling air exit holes in the trailing edge region of the airfoil and in fluid communication with the third cooling air supply cavity.

6. The turbine airfoil of claim 1, and further comprising:
the film cooling hole is a diffuser slot.

7. The turbine airfoil of claim 1, and further comprising:
the film cooling hole is a metering hole and a diffuser hole with the diffuser located downstream from the metering portion.

8. The turbine airfoil of claim 1, and further comprising:
cooling air turbulator means are formed on the outer wall surface within the impingement cell.

9. The turbine airfoil of claim 1, and further comprising:
the plurality of impingement cells each have a span-wise length of about one inch and a chord-wise length of about one half an inch.

10. The turbine airfoil of claim 9, and further comprising:
the plurality of impingement cells each have a depth of from about 0.05 inches to about 0.2 inches.

11. The turbine airfoil of claim 1, and further comprising:
the impingement hole is a metering and impingement hole.

12. The turbine airfoil of claim 11, and further comprising:
cooling air turbulator means are formed on the outer wall surface within the impingement cell.

13. The turbine airfoil of claim 1, and further comprising:
the plurality of impingement cells each have a span-wise length of about one inch and a chord-wise length of about one half an inch.

14. The turbine airfoil of claim 13, and further comprising:
the plurality of impingement cells each have a depth of from about 0.05 inches to about 0.2 inches.

15. The turbine airfoil of claim 14, and further comprising:
the impingement hole is a metering and impingement hole.

16. A process of forming a turbine airfoil having an internal cooling air supply cavity and a plurality of film cooling holes, the process comprising the steps of:

forming an airfoil main structure with a plurality of impingement cells on the pressure side and the suction side of the airfoil;

forming part of a film cooling hole on the airfoil main structure and leading from the impingement cell;

drilling an impingement hole into the impingement cell connected to the cooling air supply cavity;

placing a filler material in the impingement cell and the partial film cooling hole having the form of the impingement cell and the film cooling hole;

forming a thin outer airfoil wall over the airfoil main structure and the impingement cell; and, leaching out the filler material to form an open space forming the impingement cell and the film cooling hole leading out from the impingement cell.

17. The process of forming a turbine airfoil of claim 16, and further comprising the step of:
providing the filler material with turbulator forming means on the surface forming the thin airfoil wall such that when the filler material is leached away the inner surface of the airfoil wall includes turbulator means thereon.

18. The process of forming a turbine airfoil of claim 16, and further comprising the step of:
staggering the rows of impingement cells.

19. The process of forming a turbine airfoil of claim 16, and further comprising the step of:
forming the filler material in the film cooling hole forming portion with a diffuser forming shape.

20. The process of forming a turbine airfoil of claim 16, and further comprising the step of:
the impingement cell and the film cooling hole is formed in the airfoil by forming the outer airfoil wall over the cell and the partially formed film cooling hole and leaching out the filler material, leaving the complete impingement cell and film cooling hole opening into the impingement cell.

21. The process of forming a turbine airfoil of claim 16, and further comprising the step of:
varying the size of the impingement holes in the plurality of impingement cells to regulate the metal temperature to eliminate hot spots on the airfoil outer wall.

22. The turbine airfoil of claim 6, and further comprising:
each of the impingement cavities includes a diffuser slot with a width about as wide as the impingement cavity.

23. The turbine airfoil of claim 6, and further comprising:
the diffusion slots in the second row are wide enough to cover gaps formed between the diffusion slots in the first row.

* * * * *